US005241928A

United States Patent [19]

Hamada et al.

[11] Patent Number: 5,241,928

[45] Date of Patent: Sep. 7, 1993

[54] MOVABLE VALVE DEVICE FOR ENGINE

[75] Inventors: Shigeaki Hamada; Masato Kasai; Yasuyuki Osumi; Kiyomi Yamashita; Yoshihiko Ito, all of Shizuoka, Japan

[73] Assignee: Suzuki Motor Corp., Shizuoka, Japan

[21] Appl. No.: 2,152

[22] Filed: Jan. 11, 1993

[30] Foreign Application Priority Data

Mar. 13, 1992 [JP] Japan ..... 4-89672
Mar. 13, 1992 [JP] Japan ..... 4-89673

[51] Int. Cl.[5] ..... F01L 1/26; F01L 1/18

[52] U.S. Cl. ..... 123/90.23; 123/90.27; 123/90.39

[58] Field of Search ..... 123/90.27, 90.22, 90.23, 123/90.39, 90.4, 90.41, 90.44

[56] References Cited

U.S. PATENT DOCUMENTS 2,727,500 12/1955 Leake ..... 123/90.39
4,476,822 10/1984 Bonvallet ..... 123/90.41
4,969,426 11/1990 Fuji et al. ..... 123/90.27
4,969,427 11/1990 Hamada ..... 123/90.27
4,979,474 12/1990 Morishita ..... 123/90.27
4,995,352 2/1991 Machino ..... 123/90.39
5,027,761 7/1991 Fujii et al. ..... 123/90.27
5,060,605 10/1991 Yamazaki ..... 123/90.27
5,095,859 3/1992 Iwata et al. ..... 123/90.16
5,163,390 11/1992 Shimamoto ..... 123/90.27

FOREIGN PATENT DOCUMENTS 63-113704 7/1988 Japan .

*Primary Examiner*—E. Rollins Cross
*Assistant Examiner*—Weilun Lo
*Attorney, Agent, or Firm*—Flynn, Thiel, Boutell & Tanis

[57] ABSTRACT

A valve moving device for a combustion engine wherein a hole engagement part pivotally mounts a rocker arm on a rocker shaft. The axial centerline of the hole engagement part is provided on a slant with respect to the axial centerline of the rocker shaft, so that the axial centerline of the pivot hole of the rocker arm is slanted relative to the axial centerline of the camshaft.

7 Claims, 10 Drawing Sheets

MOVABLE VALVE DEVICE FOR ENGINE

FIELD OF THE INVENTION

This invention relates to a valve device for an engine and, more particularly, a movable valve device to open and close the valve by a camshaft through a rocker arm swingably pivoted to a rocker shaft.

BACKGROUND OF THE INVENTION

An engine has air supplying and exhausting valves to supply air into and exhaust air from a combustion chamber. These valves are typically a type of side valve system, a top upper valve system or an above valve system, etc. A movable mechanism to open and close these valves, such as a movable valve mechanism of the top upper valve system, is the type with a seesaw type or swing type rocker arm to transmit action of a cam of the camshaft to the valves.

Such a movable valve device is the type equipped on an engine of a multi-cylinder four-cycle type, as shown in FIGS. 7–11. Namely, in FIGS. 7–11, numeral 102 is a multi-cylinder four-cycle engine, 104 is a cylinder head, and 106 is a cylinder head cover. Formed on said cylinder head 104 is a combustion chamber 108 corresponding to each cylinder (not shown) in an axial direction (arrow A in FIG. 9) of the crankshaft (not shown), such as in the lengthwise direction of this cylinder head.

Formed at said cylinder head 104 are an intake port 176 and an exhaust port 178 in the widthwise direction (arrow B direction of FIG. 10) of the cylinder head 104 so as to communicate with an air supply mouth 172 and an exhaust mouth 174 which open into the combustion chamber 108. In the engine 102, the combustion chamber 108 communicates with two air supply mouths 172 and two exhaust mouths 174 and formed in the cylinder head 104 are two air intake and two exhaust ports or passages 176 and 178 respectively for communication with the combustion chamber 108. Respectively provided at the intake and exhaust mouths 172, 174 are air intake and exhaust valves 110, 112. Hence, each cylinder (not shown) is provided with two intake valves 110 and two exhaust valves 112.

Provided in the movable valve chamber 114 (FIG. 10) formed in the cylinder head 104 and cylinder head cover 106 is a movable valve device 116 to open and close the mouths 172 and 174 by opening and closing the valves 110 and 112. A camshaft 118 is positioned eccentric to one side (in widthwise direction) of the cylinder head 104, and extends in the lengthwise direction of the cylinder head 104, and is rotated by a timing belt. This camshaft 118 is rotatably supported at an upper portion of the cylinder head 104 by a camshaft cap 180. This camshaft 118 has thereon, as shown in FIGS. 9–10, two intake cams 122 corresponding to valves 110 associated with one cylinder (not shown) and two exhaust cams 124 corresponding to the exhaust valve 112.

Parallelly provided on an upper portion of the cylinder head 104 are, as shown in FIGS. 9 and 10, a plurality of rocker shaft supports 126 spaced in the lengthwise direction A of the cylinder head. Respectively formed in each of these rocker shaft supports 126 is a hole 128 (FIG. 11) for a holder pipe, which hole is oriented vertically and aligned with the centerline of the combustion chamber. Respectively, inserted into each hole 128 and fixed therein is a holder pipe 132 which forms an ignition plug port 130. Passed from an upper portion through this ignition plug port 130 of each holder pipe 132 is an ignition plug 134 located at a center of the combustion chamber 108 of the cylinder head 104, and fixed on the cylinder head 104.

Provided on an upper part of each rocker shaft support 126 is a rocker shaft cap 140 which pivotably or rotatably supports a rocker shaft 138. This rocker shaft cap 140 is, as shown in FIG. 7, formed with a plug hole 142 oriented vertically therethrough so as to mate to the holder pipe 132, a rocker shaft holding slit 144 at a cap side oriented in a transverse direction at lower face side to hold an upper part of the rocker shaft, and bolt holes 146 through which mounting bolts 180 extend to fix the cap 140 to the support 126.

A plurality of rocker shafts 138 are provided and are located on the same straight line along the lengthwise direction. Each of the rocker shafts 138 is held at opposite ends by neighboring rocker shaft caps 140, as shown in FIG. 9.

Provided swingably on each rocker shaft 138 are a plurality of, such as two, intake rocker arms 148. This intake rocker arm 148 has, as shown in FIG. 8, a pivoting hole 150 at an intermediate part thereof, contact face 152 at one side thereof slidable on an absorbing cam face **122*f* of the intake cam 122, and an abut member 154 at another side thereof to abut an intake valve stem abut member 110A of the intake valve 110**.

Each rocker shaft 138 is located on the same straight line so that a center axial line of the rocker shaft 138 and a center axial line 118C of the camshaft 118 are parallel.

The rocker arm 148 is designed wherein the intake abut member 154 which is a front tip side is formed curved toward the ignition plug 134 side, as shown in FIG. 8, as the ignition plug 134 is located generally at a center part of the combustion chamber 108.

Swingably provided on the upper part of the cylinder head 104 in the movable valve chamber 114, by a head-side pivot 188, is a pivot member 186 of a swing type exhaust rocker arm 184, as shown in FIG. 10. In other words, the exhaust rocker arm 184 is provided corresponding to the exhaust cam 124. This rocker arm 184 has the pivot member 186 at one side thereof, a contact face 190 on one face at another side thereof slidable on a cam face **124*f* of the exhaust cam 124, and an abutting member 192 at another face of this another end side for abutting the stem abutting member 112A of the exhaust valve 112**.

Furthermore, there is a prior art four-cycle engine movable valve device, as disclosed in laid open Japanese U.M. Publication No. Sho 63-113704 (1988), which is opened and closed by one camshaft provided with two intake valves and two exhaust valves for one cylinder, wherein an ignition plug inserted in a vertical hole at an upper part of a combustion chamber is provided at a center of the combustion chamber, a camshaft is rotatably pivoted with a shaft on a face of a cylinder head by a bearing cap after it is positioned closer to the exhaust valve, the exhaust rocker arm is swingable, and the rocker shaft is held at opposite ends and pivotably supports the intake rocker arm to the rocker shaft holder attached on the cylinder head so as to surround the vertical hole.

To this end, in the conventional movable valve device of the engine, the ignition plug 134 is, as shown in FIGS. 9 and 11, located at a generally center part of the combustion engine 108, and the intake abutting member 154 of the intake rocker arm 148 is formed curvedly.

Furthermore, a central axial line 118C of the camshaft 118 and a central axial line 150C of a support member 150 of the intake rocker arm 148 are provided in parallel. For this reason, a load is provided at point a at the intake abutting member 154 side, and at point b of the axis support member 150 part, and at point c of the absorbing contact face 152 part, as shown in FIG. 8, upon driving of the engine 102. As these load affecting points a, b and c are not positioned on a straight line, there is a drawback in practice in that a fall down is created by loads to each of these points at the intake rocker arm 148 upon opening of the intake valve 110, the intake contact face 152 of the intake rocker arm 148 eccentrically abuts the absorbing cam face **122*f* of the intake cam 122, and early or rapid wear of the contact face 152 and cam face 122*f***, burning and abnormal noise, etc., are likely created.

Furthermore, in the conventional intake rocker arm 148, as the abutting member 154 side is curvedly formed and the load affecting point b takes a position on a center axial line 150C of the axis support member 150, a torsional moment is received, and there is a drawback from this shape in that strength/rigidity of the intake rocker arm 148 is lowered.

To overcome this drawback, this invention is characterized in that the movable valve device of the engine comprises a rocker shaft cap to pivot the rocker shaft on an upper part of the engine, said rocker shaft cap being formed with a main body and a plug hole member drilled generally at the center of this main body member, the valves being opened and closed by a camshaft through a rocker arm swingably pivoted on the rocker shaft, wherein a hole engaging member to engage the rocker arm around an outer periphery of said rocker shaft is provided, a center axial line of the axis support at the rocker arm through which said hole engaging member is inserted is slanted with respect to an axial centerline of said camshaft to provide said rocker arm to the engine, and an axial centerline of said hole engaging member is slanted with respect to an axial centerline of said rocker shaft.

In a variation, this invention is characterized in that to solve said drawback, an engine movable valve device comprises one cylinder of the engine having two intake valves and two exhaust valves, an ignition plug is generally at a center part of said combustion chamber, one camshaft opens and closes said intake and exhaust valves, and intake rocker arms and exhaust rocker arms transmit cam operation of this camshaft to said intake and exhaust valves. A cylindrical slanted eccentric spacer cooperates between the rocker arm and rocker shaft so as to slant the pivot axis of the arm pivot with respect to the axial centerline of the cam.

According to the invention, although a contact face of the rocker arm is slanted with respect to the intake cam face of the cam of the camshaft, immediately before functioning of the rocker arm, a face pressure between the contact face and the intake cam face is not likely to cause wear, burning, etc. When the rocker arm begins to operate about the center axial line of the axis support, the contact face of the rocker arm does not eccentrically abut onto the intake cam face of the camshaft, that is the contact face contact is generally evenly applied onto the cam face of the intake cam of the camshaft to prevent early wear, burn and abnormal noise of the contact and cam faces, and to give torsional moment to the rocker arm, and to improve strength/rigidity of the rocker arm.

Now, preferred embodiments will be hereinafter discussed with reference to the accompanying drawings.

DETAILED DESCRIPTION

Figure 1:
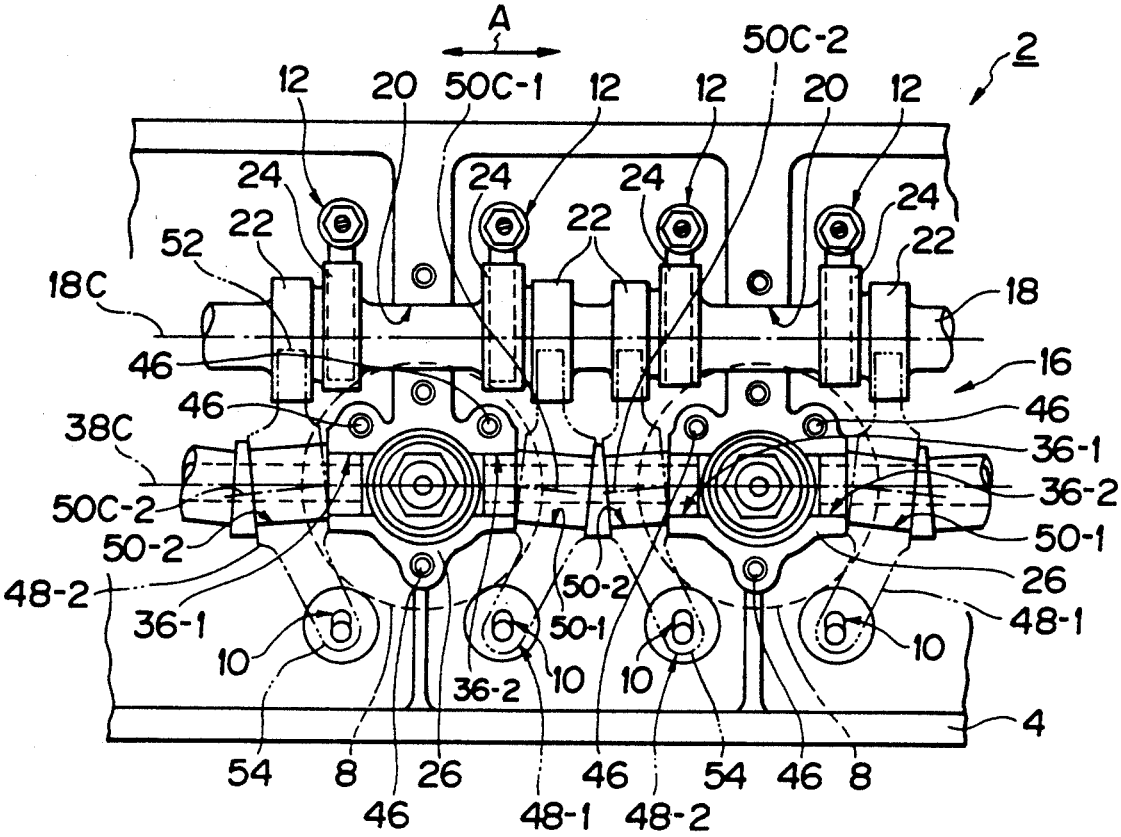
FIG. 1 is a plan view of a movable valve device showing an embodiment of this invention.

FIGS. 1–4 illustrate an embodiment of this invention. In FIGS. 1–4, 2 is a four-cycle multi-cylinder combustion engine, 4 is a cylinder head, and 6 is a cylinder head cover. Formed on the cylinder head 4 is a combustion chamber corresponding to each cylinder (not shown), in lengthwise direction of this cylinder head 4, namely axial direction (arrow A direction) of the crank axis (not shown).

Formed on said cylinder head 4 are an intake port (not shown) and exhaust port (not shown) in its widthwise direction to communicate with an intake mouth (not shown) and exhaust mouth (not shown) which open into the combustion chamber 8. In this embodiment, two intake and two exhaust mouths open into each combustion chamber 8, and two intake ports (not shown) and two exhaust ports (not shown) are formed in the cylinder head 4.

Provided in the intake system of the engine 2 are two intake valves 10, 10 for each combustion chamber 8 to open and close each intake mouth (not shown), and provided in the exhaust system of the engine are two exhaust valves 12, 12 to open and close the exhaust mouth (not shown).

Provided in the movable valve chamber 14 formed by the cylinder head 4 and the cylinder head cover 6 is the movable valve device 16 to open and close the respective intake and exhaust mouths by opening and closing the intake valves 10 and exhaust valves 12.

Provided at this movable valve device 16 is a camshaft 18 eccentrically positioned to one side of the cylinder head 4 in the widthwise direction thereof, and axially oriented in the lengthwise direction (arrow A direction) of the cylinder head 4 and rotated by a timing belt (not shown). This camshaft 18 is held at its lower part in a recess 20 formed on the cylinder head 4, and held at its upper part in a recess (not shown) formed on the camshaft cap (not shown).

Provided on the camshaft 18 are an intake cam 22 corresponding to each intake valve 10 and an exhaust cam 24 corresponding to each exhaust valve 12.

Figure 2:
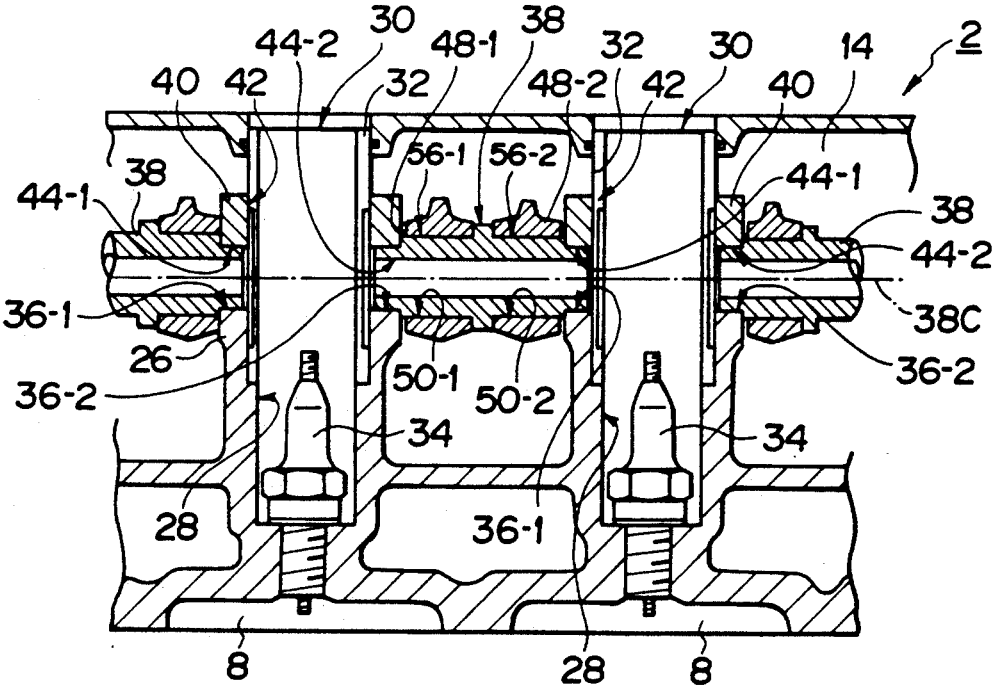
FIG. 2 is a cross section of the movable valve device of the engine.

Provided on an upper part of the cylinder head 4 are a plurality of rocker shaft supports 26 spaced along the lengthwise direction A of the cylinder head 4 (see FIGS. 1 and 2).

Formed at each of these rocker shaft supports 26 are through holes 28 for holder pipes, which holes 28 are oriented vertically at a center part of the combustion chamber 8. A holder pipe 32 forming an ignition plug accommodation hole 30 is inserted into each of the holes 28 and is fixed therein. The hole 30 is positioned at a center part of (and coaxially aligned with) the combustion chamber 8, and an ignition plug 34 is inserted from above and fixed to the cylinder head 4.

Formed on the upper face of each rocker shaft support 26, at opposite sides of the hole 28, are semi-cylindrical openings or slits 36 for accommodating the rocker shafts 38. Held in each slit 36 is the end of one of the rocker shafts 38, which shafts 38 are aligned on the same straight line or axis.

Referring specifically to one said rocker shaft support 26, engaged at the slit 36-1 at one side of the opening 28 is one end part of one rocker shaft 38, and engaged in the slit 36-2 at the other side is one end part of another rocker shaft 38. At this time, the axial centerlines 38C of rocker shafts 38 are aligned and are parallel to a center axial line 18C of camshaft 18.

Attached to the upper part of each of the rocker shaft supports 26 is a rocker shaft cap 40 to pivotally support said rocker shafts 38. This cap 40 has, as shown in FIG. 2, a through hole 42 oriented generally vertically to accommodate the holder pipe 32, holding slits 44-1, 44-2 at the lower face formed corresponding to slits 36 for receiving the rocker shaft top half so as to hold the rocker shaft 38, and bolt holes 46 to receive mounting bolts (not shown) therein to fix said cap 40 to the shaft support 26. Engaged in the cap holding slit 44-1 is one end part of one rocker shaft 38, and engaged in the other cap slit 44-2 is one end part of another rocker shaft 38. Each said rocker shaft 38 is thus held at opposite ends by caps 40, 40.

Figure 4:
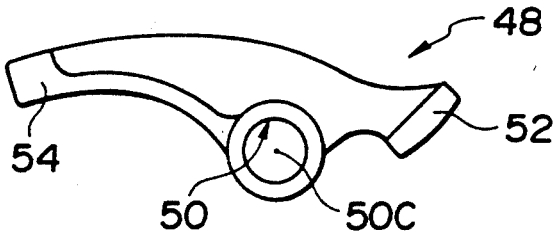
FIG. 4 is a side view of the rocker arm.

Swingably provided at each rocker shaft 38 are a plurality (here two) of intake rocker arms 48. Provided on said intake rocker arm 48 are, as shown in FIG. 4, an intermediate axis support part 50, an intake contact face 52 at one end which is slidably engageable with a cam face of the intake cam 22, and an intake abut member 54 at the other end for abutting the valve stem abutting member.

Provided around the outer circumference of said rocker shaft 38 are cylindrical hole engaging parts 56-1 and 56-2 which are supported in the support hole parts 50 of the rocker arms 48-1 and 48-2. The centerlines 50C-1 and 50C-2 of parts 56-1 and 56-2 are slanted (i.e. sloped) with respect to the axial centerline 18C of camshaft 18, so as to locate said intake rocker arm 48 relative to the engine 2 so that the axial centerline 56C of part 56 is slanted relative to the axial centerline 38C of rocker shaft 38.

Figure 3:
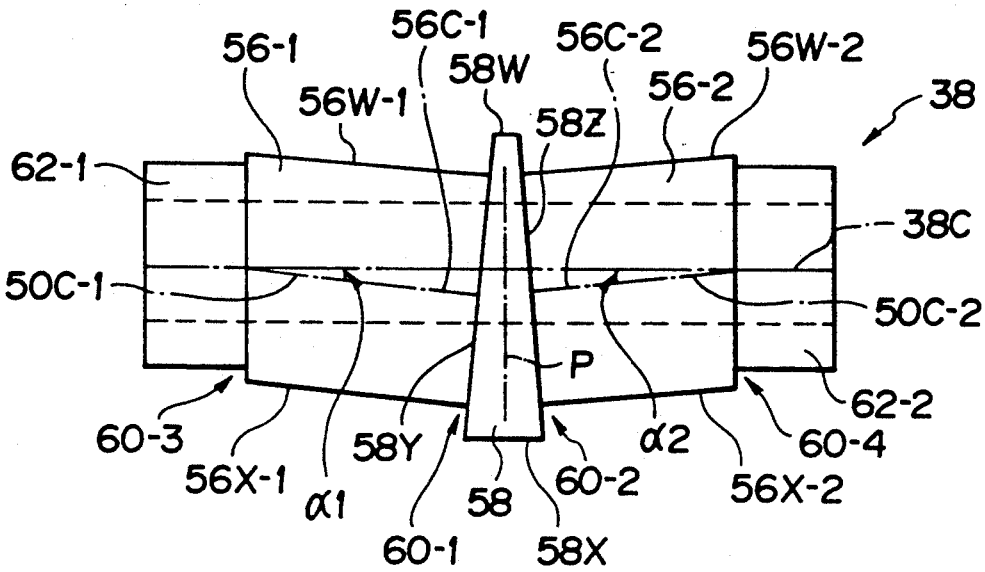
FIG. 3 is an enlarged plan view of the rocker shaft.

Discussing in detail, and as shown in FIG. 3, rocker shaft 38 is provided with a large diameter central part 58 for positioning between the intake rocker arms 48-1 and 48-2. Provided at both sides of this central part 58 are the first and second hole engaging parts 56-1, 56-2 which terminate at first and second steps or shoulders 60-1, 60-2. Axially outwardly of these first and second hole engaging parts 56-1, 56-2 are first and second cylindrical slit engagements or hubs 62-1, 62-2 for engagement between slits 36 and 44, which hubs terminate at third and fourth steps or shoulders 60-3, 60-4. The shaft 38 is thus generally symmetrical about a central transverse plane.

The large diameter central part 58 is formed, as shown in FIG. 3, so as to be axially wider at one side 58X than at the diametrically opposite side 58W, and is formed at opposite ends by end faces 58Y and 58Z which define transverse planes which are slightly slanted in opposite directions relative to a central perpendicular plane P.

The first hole engaging part 56-1 is formed as a cylindrical hub which projects perpendicularly from surface 58Y, whereby the sides 56W-1 and 56X-1 are parallel, and an axial centerline 56C-1 of the hub 56-1 is slanted, as shown in FIG. 3, at a small given angle $\alpha 1$ (in clockwise direction in FIG. 3) with respect to the axial centerline 38C of the rocker shaft 38.

The second hole engaging part 56-2 is similarly formed whereby its axial centerline 56C-2 projects perpendicularly from surface 58Z and is slanted at a small given angle $\alpha 2$ in counterclockwise direction with respect to the axial centerline 38C of the rocker shaft 38. These centerlines 50C-1 and 50C-2 are in the same axial plane, and the angles $\alpha 1$ and $\alpha 2$ are the same in degree and slope in opposite directions relative to the rocker shaft axis 38C.

With reference to a single rocker shaft 38, the first hole engaging part 56-1 is, as shown in FIG. 2, inserted in the pivot hole 50-1 of one intake rocker arm 48-1 as associated with one combustion chamber 8, and the second hole engaging part 56-2 is inserted in the pivot hole 50-2 of another rocker arm 48-2 as associated with an adjacent combustion chamber 8. When so assembled, the axial centerline 56C-1 of the first hole engaging part 56-1 and the axial centerline 50C-1 of one pivot hole 50-1 are aligned, the axial centerline 56C-2 of the second hole engaging part 56-2 and the axial centerline 50C-2 of the other pivot hole 50-2 are aligned, and the axial centerline 38C of the rocker shaft 38 is positioned in parallel to the axial centerline 18C of the camshaft 18.

By means of the above construction, when the rocker shaft 38 is provided on the engine 2, one intake rocker arm 48-1 pivots about the axial centerline 50C-1 which slants at angle $\alpha 1$ in a clockwise direction with respect to the axial centerline 18C only in a predetermined plane, and the other rocker arm 48-2 pivots about the axial centerline 50C-2 which slants at angle $\alpha 2$ in a counterclockwise direction with respect to the axial centerline 18C in the same predetermined plane, which plane is generally horizontal.

The operation will be briefly discussed.

Immediately before operation of the intake rocker arm 48, such as immediately before operation of the engine 2, the contact face 52 of this intake rocker arm 48 is slanted with respect to the intake cam face of the intake cam 22 on the camshaft 18, but at this moment facial pressure between the contact face 52 and the cam face is low and is not likely to cause wear, burn, etc.

When the intake rocker arm 48 begins to be operated about the axial centerline 50C of the pivot hole 50, the contact face 52 of the intake rocker arm 48 moves in a direction such that face 52 becomes parallel to the cam face of said intake cam 22, so contact face 52 generally evenly contacts the cam face of said intake cam 22, whereby the contact face 52 of the intake rocker arm 48 is prevented from abutting impact with the intake cam face. By this even abutment between the contact face 52 and the intake cam face, creation of abnormal wear, burn and noise is reduced, and aging induced change of the valve clearance is reduced.

As shown in FIG. 1, as the axial centerline 50C of the hole engagement part 56 is slanted in the horizontal planar direction with respect to the axial centerline 18C of the camshaft 18, distortional moment to the intake rocker arm 48 is reduced, so as to improve strength and rigidity of said intake rocker arm 48, which is advantageous in practice.

Furthermore, as the strength and rigidity of the intake rocker arm 48 are raised, dynamic performance of the movable valve system is improved, and performance of the engine is increased.

Figure 5:
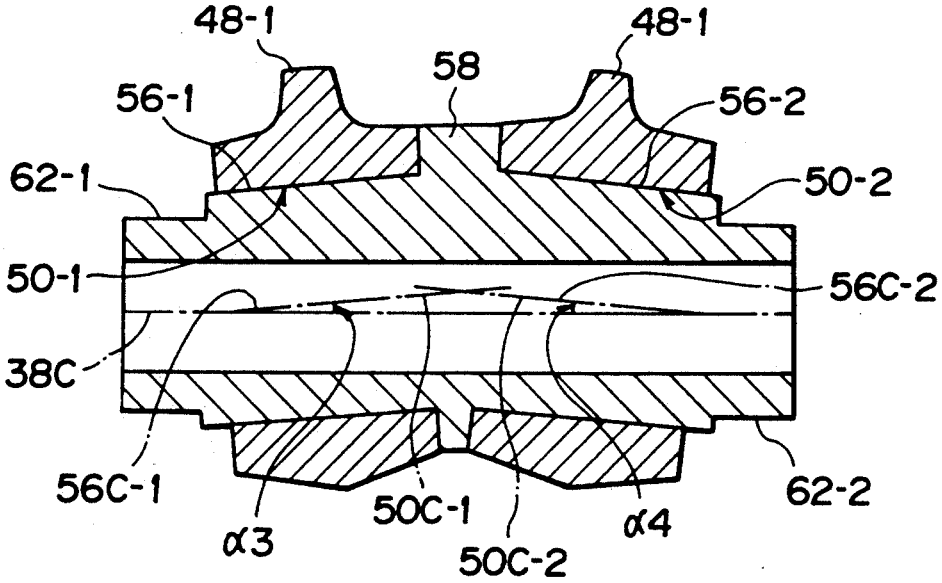
FIG. 5 is an enlarged cross section of the rocker shaft and rocker arm, showing another embodiment of this invention.

Furthermore, as shown in FIGS. 2 and 5, as the axial centerline 56C of the hole engagement part 56 is slanted in a horizontal planar direction with respect to the axial centerline 18C of the camshaft 18, the intake contact face 52 is generally evenly contacted onto the intake cam face of the intake cam 22 upon operation of the engine 2, and early wear, burn and noise creation between the contact face 52 and cam face are minimized or prevented, which is advantageous in practice.

As shown in FIG. 5, as the intake contact face 52 of the intake rocker arm 48 is parallel to the axial centerline 48C of the rocker arm 48, it is advantageous to construction of said intake rocker arm 48.

Furthermore, as it is designed that the axial centerline 56C of the engagement part 56 provided around the outer circumference of the rocker shaft 38 is provided at a slant with respect to the axial centerline 38C of the rocker shaft 38, parts for a conventional intake rocker arm 38, etc., are usable per se, and there is no big burden on productivity and manufacturability, which is economically advantageous.

To this end, this invention is not limited to said embodiments, and various modifications are possible.

Figure 6:
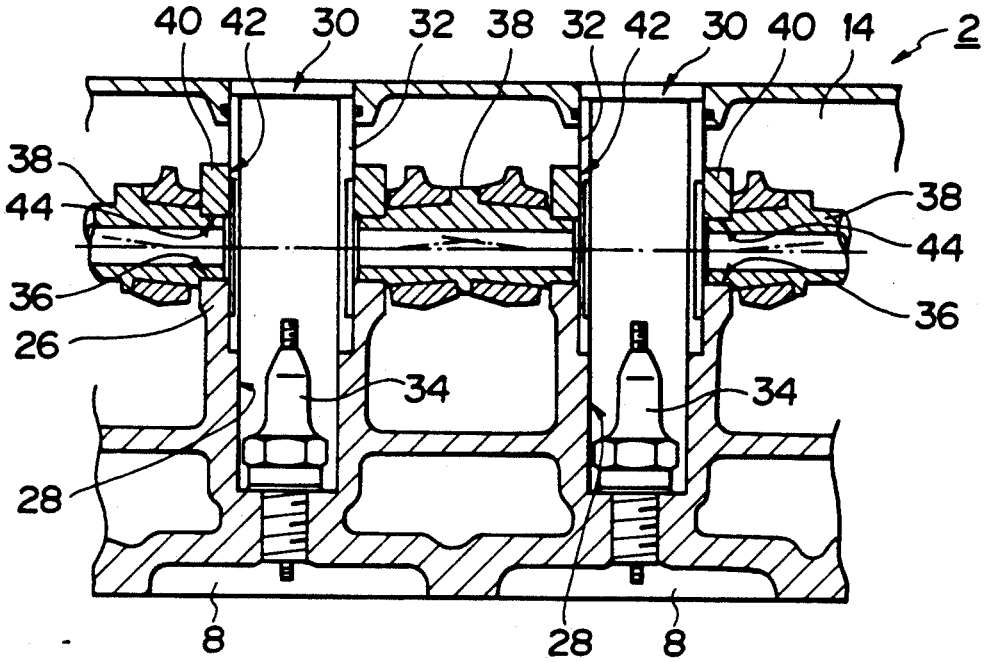
FIG. 6 is a cross section of a movable valve device of the engine according to a variation of the invention.
Figure 7:
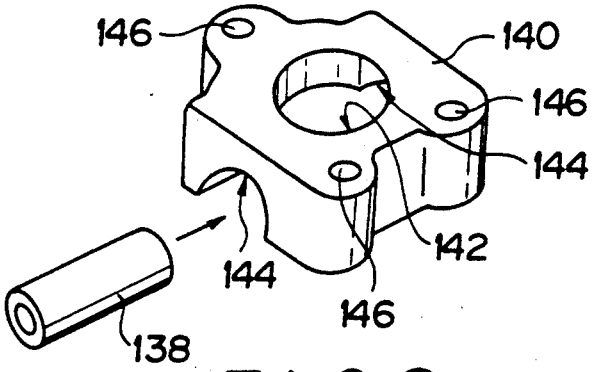
FIG. 7 PRIOR ART
FIG. 7 is a perspective view of the rocker shaft and rocker shaft cap according to the prior art.
Figure 8:
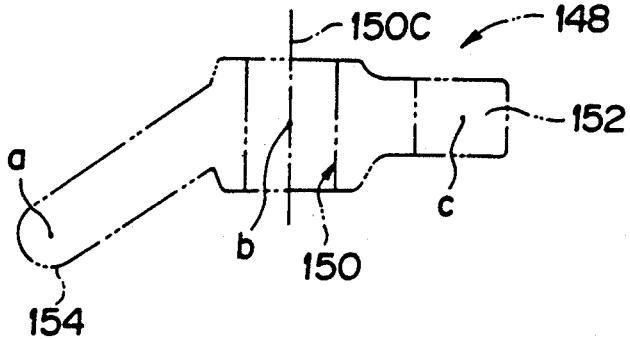
FIG. 8 PRIOR ART
FIG. 8 is an outline explanatory view of the prior art rocker arm.
Figure 9:
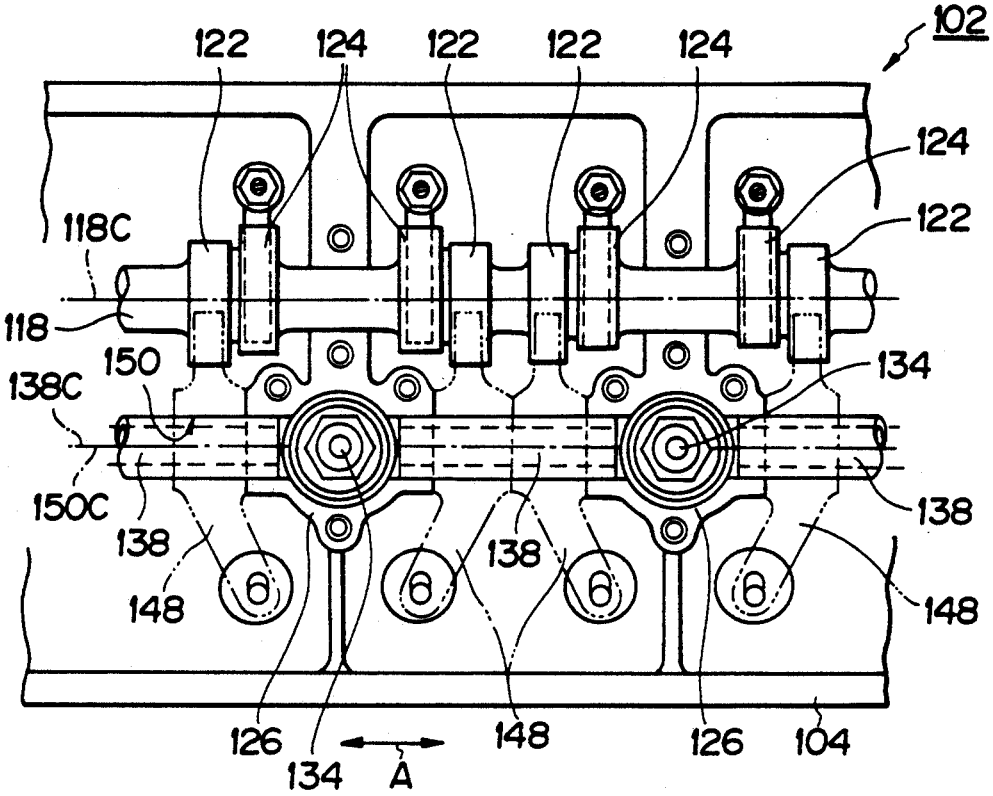
FIG. 9 PRIOR ART
FIG. 9 is a plan view of the movable valve device of an engine according to the prior art.
Figure 10:
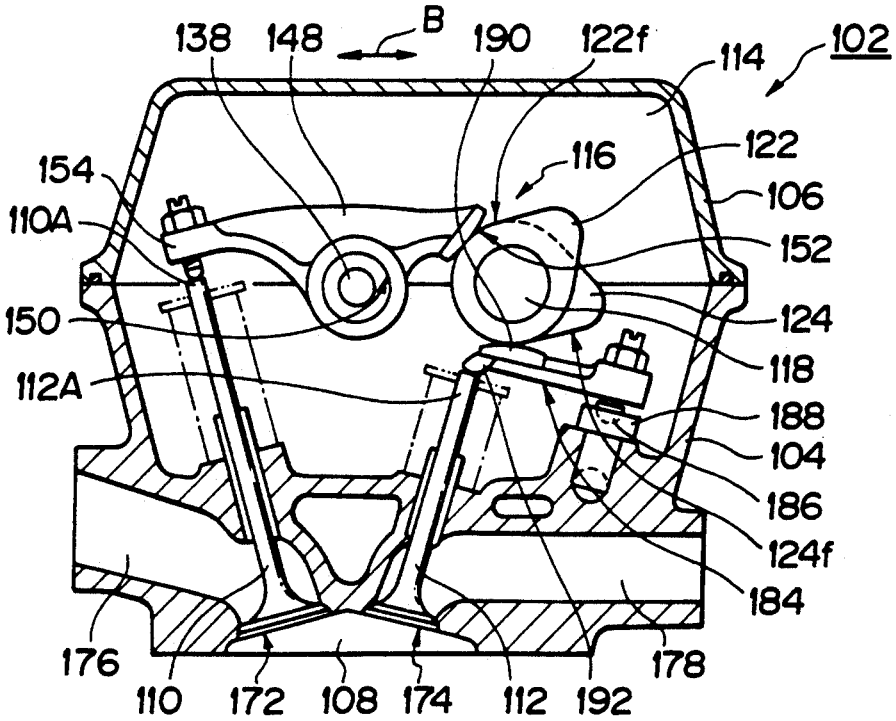
FIG. 10 PRIOR ART
FIG. 10 is a cross section of the movable valve device of FIG. 9.
Figure 11:
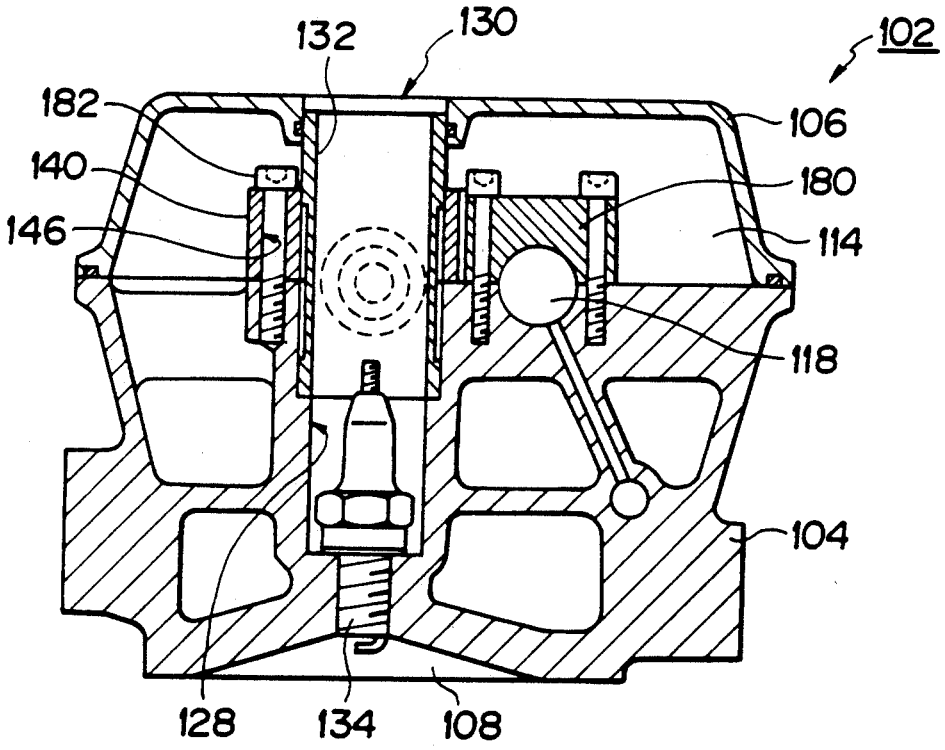
FIG. 11 PRIOR ART
FIG. 11 is a cross section of the movable valve device of FIG. 9.

For example, although in the described embodiments of this invention there is provided a constitution wherein the pivot hole 50-1 of one rocker arm 48-1 and the pivot hole 50-2 of another rocker arm 48-2 are slanted, respectively only on a horizontal plane, it is possible to change the location of slant of the rocker shaft 38 to the slit 36 for the headside rocker shaft, and shape of the first and second hole engagement parts 56-1, 56-2, according to construction of the movable valve, value of the load at opening and closing of the intake valve 10 when the intake rocker arm 48 is slanted, for example, as shown in FIGS. 5 and 6, one intake rocker arm 48-1 is provided to slant the axial centerline C-1 of the pivot hole 50-1 of the one absorbing rocker arm 48-1 for given angle $\alpha 3$ in counterclockwise direction with respect to the axial centerline 18C of the camshaft 18 only in the vertical plane, and provides another intake rocker arm 48-2 to slant the axial centerline 50C-2 of the pivot hole 50-2 of another intake rocker arm 48-2 for given angle $\alpha 4$ in counterclockwise direction with respect to the axial centerline 18C of the camshaft 18 only in a vertical plane.

Although in said embodiments the pivot hole of one intake rocker arm and the pivot hole of another intake rocker arm are slanted, respectively, only on a horizontal plane, or vertical plane, it is possible to slant the pivot hole of one intake rocker arm and the pivot hole of another intake rocker arm on horizontal plane and vertical plane, respectively by rotating this rocker shaft in circumferential direction at location of the rocker shaft.

Now, a variation of this invention will be discussed with reference to FIGS. 12–19. In this variation, the same reference numbers utilized above are again used to identify corresponding parts, which parts will not again be described in detail.

Figure 12:
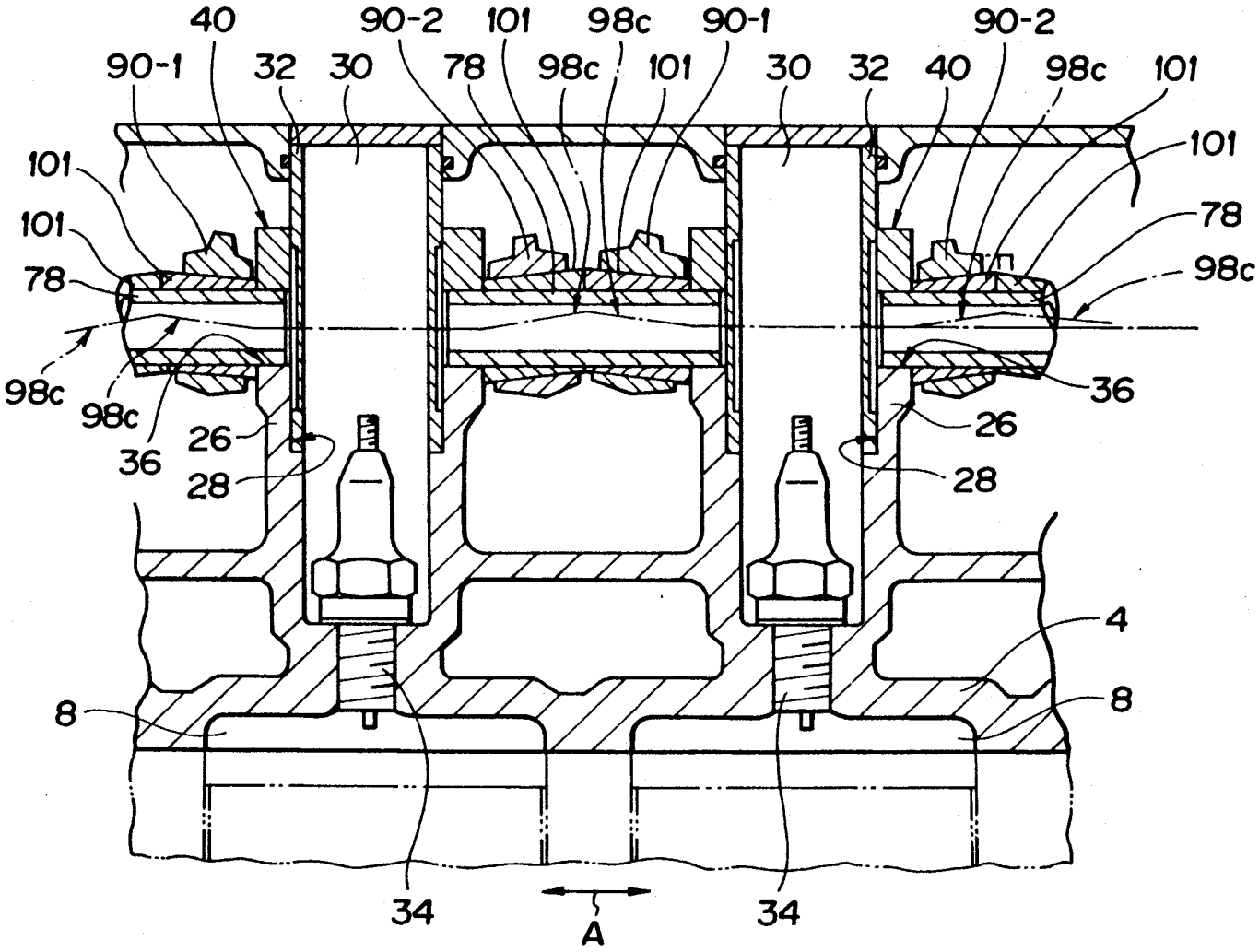
FIG. 12 is a partial longitudinal cross sectional view of an engine movable valve device, when the pivot hole axial centerline of the pivot hole of the rocker arm is slanted with respect to the cam axis centerline in a vertical planar direction.
Figure 13:
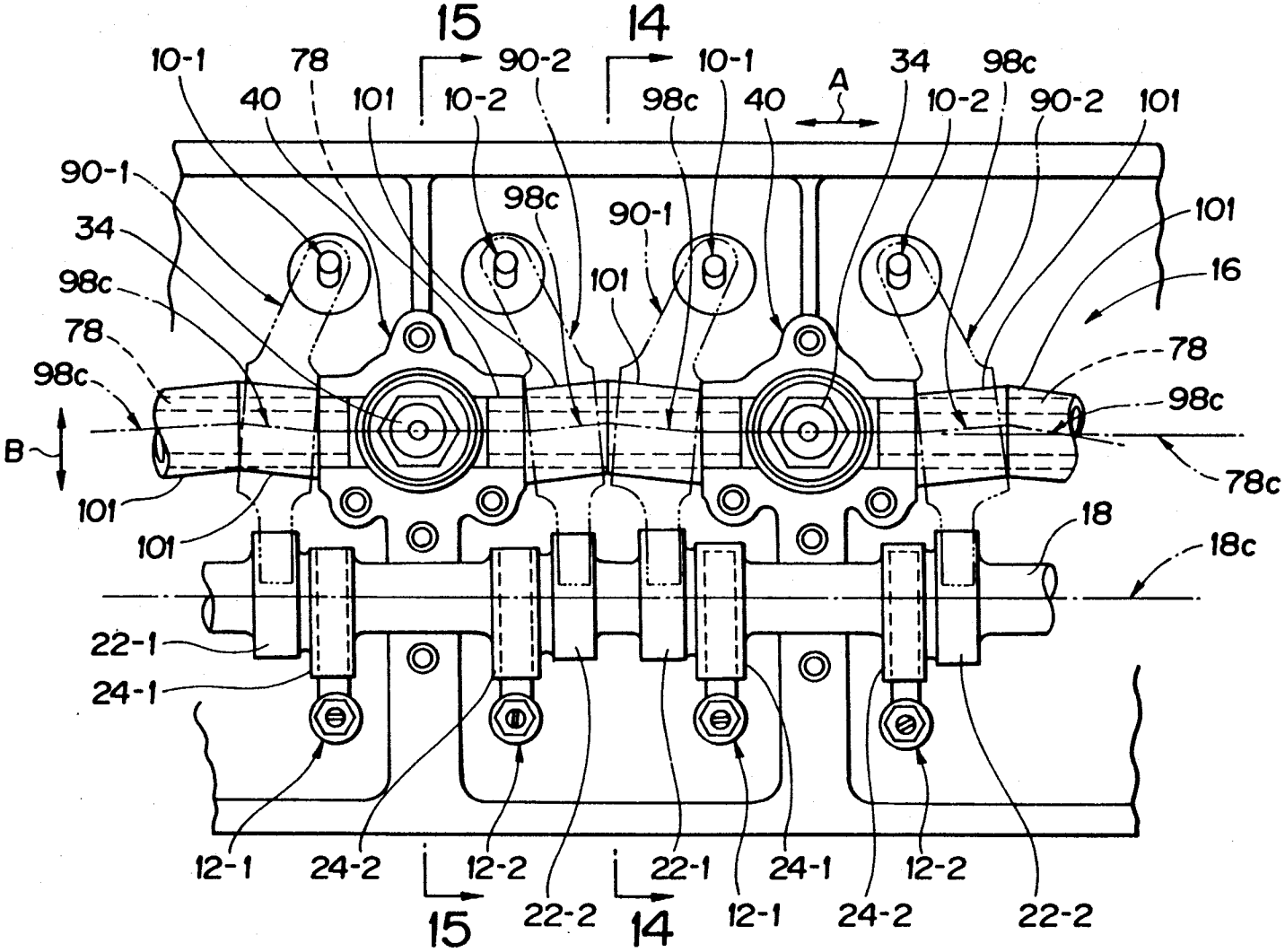
FIG. 13 is a plan view of the engine movable valve device when the pivot hole axial centerline of the pivot hole of the rocker arm is slanted with respect to the cam axis centerline.

In this variation, each rocker axle or shaft 78 is formed as a cylindrical tube and, as shown in FIGS. 12 and 13, its opposite ends are held by adjacent rocker caps 40, 40. Swingably provided on these rocker axles 78 are a plurality of intake rocker arms 90. Namely, provided for each cylinder 8 is an intake rocker arm 90-1 corresponding to the intake valve 10-1 at an end of the rocker axle 78 held at one side of the rocker cap 40, and provided at an end of the rocker axle 78 held at another side of said rocker cap 40 is an intake rocker arm 90-2 corresponding to the intake valve 10-2.

Figure 14:
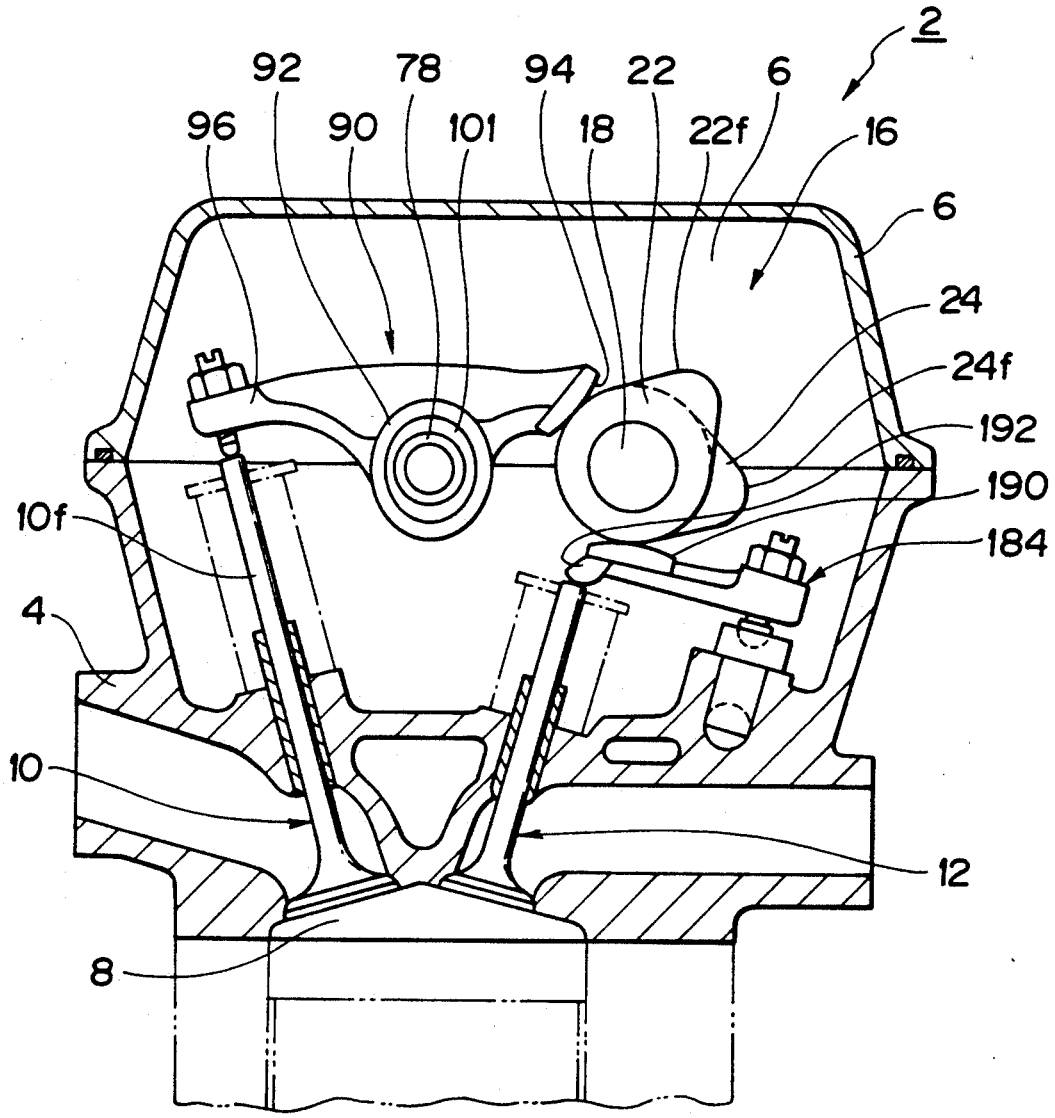
FIG. 14 is a cross section of the movable valve device along line 13—13 in FIG. 13.
Figure 15:
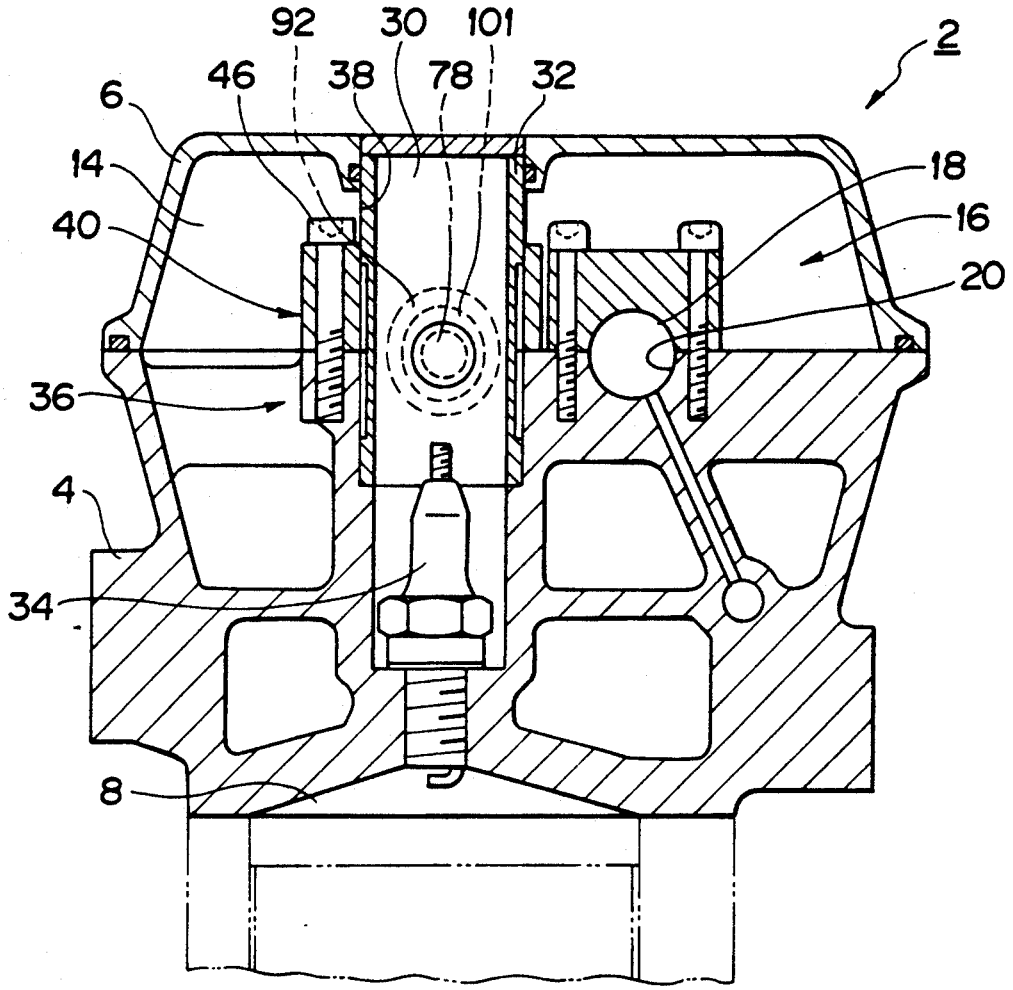
FIG. 15 is a cross section of the movable valve device along line 15—15 in FIG. 13.
Figure 16:
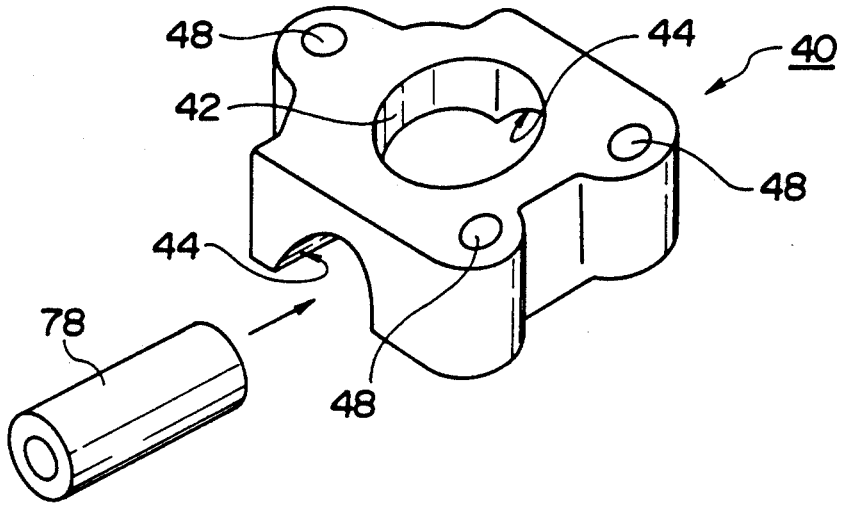
FIG. 16 is an assembly perspective view of the rocker axis and the rocker axis cap.
Figure 17:
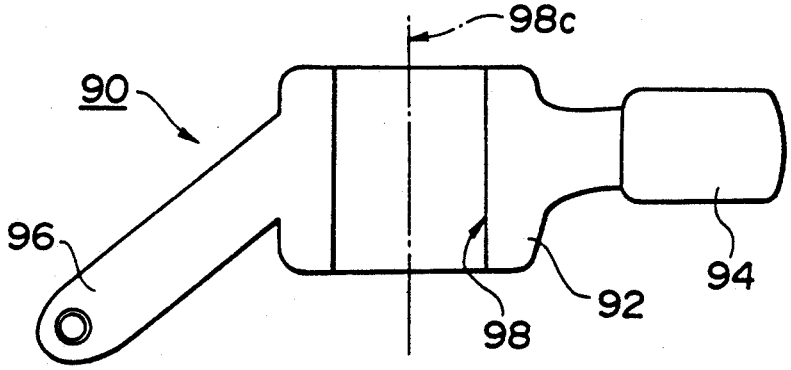
FIG. 17 is a general view of the intake rocker arm.

Provided at this intake rocker arm 90 are, as shown in FIGS. 14 and 17, an intake pivot part 92 intermediate the ends thereof, an absorbing slipper or contact face 92 at one end thereof which is slidable on an absorbing cam face 22*f* of the intake cam 22, and an absorbing abutment 96 at the other end thereof to abut against an intake valve stem abutment 10*f*. Formed at said arm shaft pivot part 92 is a pivot hole 98 (see FIG. 17).

This intake rocker arm 90 is formed at its abutment 96 side curved toward the ignition plug 34 side, as shown in FIG. 13 in plan view, as the ignition plug 34 is provided at the center of the combustion chamber 8.

To this end, in this embodiment, as shown in FIG. 12 or 13, pressedly provided in a pivot hole 98 of said arm pivot 92 is a rocker arm slanting spacer 101. This spacer 101 is formed as a cylindrical sleeve having a slanted cylindrical hole 106 therethrough to mount on the rocker shaft and hence slant the intake rocker arm 90 with respect to the axial centerline 18C of the camshaft 18.

Namely, as shown in FIG. 17, said intake rocker arm 90 is of conventional shape and has, at its center arm pivot part 92, a cylindrical pivot hole 98 formed on an axial centerline 98C, which hole 98 extends perpendicularly through the part 92.

Figure 18:
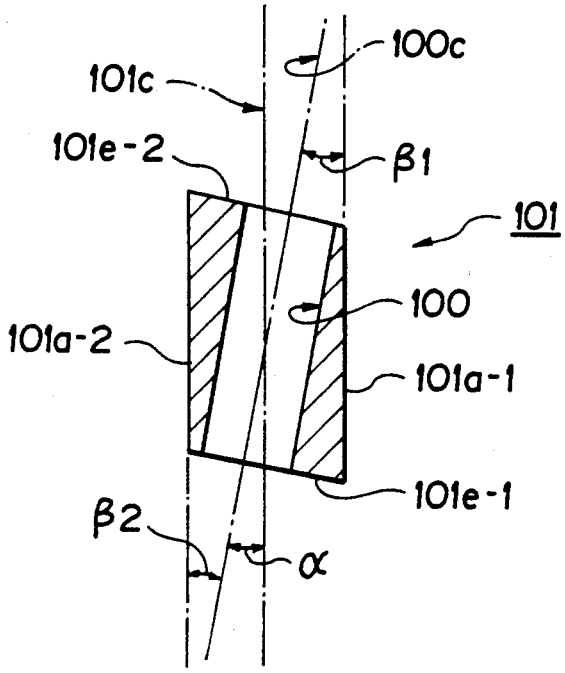
FIG. 18 is a cross section of the rocker arm slanting spacer.

While, as shown in FIG. 18, said rocker arm spacer 101 is of circular cross section, and sloped end faces 101*e*-1 and 101*e*-2 form a rhombus in cross section. Passed through this spacer 101 is the cylindrical hole 106 whose axial centerline 100C is slanted (i.e. sloped) at a small angle $\alpha$ with respect to the axial centerline 101C of this cylindrical spacer 101. Hence, in this rocker arm spacer 101, one side outer face 101*a*-1, and another side outer face 101a-2 are in parallel to the spacer axial centerline 101C, and one side slants at angle $\beta 1$ and the other side slants at angle $\beta 2$ with respect to the insertion hole axial centerline 100C. These angles $\alpha$, $\beta 1$ and $\beta 2$ are generally equal.

Hence, when this spacer 101 is pressed into the pivot hole 98 of the rocker arm, the insertion hole axial centerline 100C assumes a position slanted at an angle $\alpha$ with respect to rocker pivot hole axial centerline 98C and spacer axial centerline 101C. As a result, when this rocker insertion hole 100 receives therein the rocker axle 78 as held by the rocker caps 40, the pivot hole axial centerline 98C of the rocker arm takes a position slanted at a given angle with respect to the camshaft centerline 18C of the camshaft, as shown in FIG. 12 or 13.

Discussed in detail, when slanting the intake rocker arm 90, due to the slant of the pivot hole axial centerline 98C of the rocker arm 90 with respect to the cam axial centerline 18C of the camshaft 18, the location of the slanting spacer 101 relative to the pivot hole 98 and the forming position of the inserting hole 100 can be changed, for example, as shown in FIG. 12. The pivot hole axial centerline 98C is slanted in two dimensions in a vertical plane with respect to the cam axis centerline 18C, or as shown in FIG. 13 the pivot hole axial centerline 98C is slanted in two dimensions in a horizontal plane. Namely, the supporting direction of the intake rocker arm 90 is slanted at a given angle in a vertical plane direction or horizontal plane direction, and the value of slanting direction or slant value of the intake rocker arm 90 is decided by the value of the load for opening and closing the intake valve 10. Furthermore, it is possible to slant the intake rocker arm 90 in three dimensions to include both vertical and horizontal components in the slant angle.

Immediately before operation of the intake rocker arm 90, the contact face 94 of rocker arm 90 is in a state of slant with respect to the intake cam face 22f. However, at this moment, facial pressure between the contact face 94 and the intake cam face 22f is low, and there is likely to be no wear, burn, etc.

When the engine 2 starts, and the camshaft 18 rotates to operate the intake rocker arm 90, the rocker arm 90 falls or moves in a direction about the pivot hole axial centerline 98C and the insertion hole axial centerline 100C such that the contact face 94 becomes parallel to the intake cam face 22f.

Namely, for example, as shown in FIG. 12, if the pivot hole axial centerline 98C is slanted in a vertical plane direction with respect to the cam axial centerline 18C, it is possible to generally uniformly contact the contact face 94 and the intake cam face 22f to avoid eccentric abutment. Thus, as it is possible to prevent the eccentric abutment between the faces 94 and 22f, whereby early wear, burn and abnormal noise creation is prevented or minimized, and this lessens aging change of valve clearance.

For example, if the pivot hole axial centerline 98C in rocker arm 90 is slanted in a horizontal plane direction with respect to the cam axial centerline 52C, torsional movement between the load affecting points a and b is reduced, and strength and rigidity of the absorbing rocker arm 90 are raised, to improve dynamic performance of the movable valve system, which raises performance of the engine.

Figure 19:
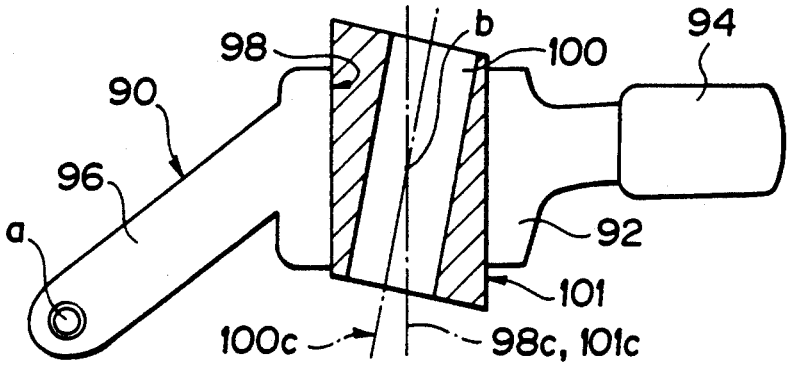
FIG. 19 is a general view of the mount of the rocker arm slanting spacer to the intake rocker arm.

As shown in FIG. 19, as the contact or slipper face 94 of the intake rocker arm 90 is in parallel to the spacer axial centerline 101C, it is advantageous with respect to manufacturing of the rocker arm 90.

Furthermore, as intervention of the slanting spacer 101 in the pivot hole 98 of the arm pivot part 92 of the conventional rocker arm 90 causes the pivot hole axial centerline 98C of pivot hole 98 to slant with respect to the cam axial centerline 18C, parts for conventional rocker axles 78 and intake rocker arms 90, etc., are usable per se, and it is advantageous in practice, without imposing a burden on productivity and manufacturability.

As apparent from the foregoing, according to this invention, the supporting direction of the rocker arm is slanted for a given angle in vertical and/or horizontal planar directions by changing the location of the slanting spacer relative to the pivot hole and the formation position of the rocker axis insertion hole, and when the rocker arm is operated, the rocker arm contact face creates a fall in a direction in parallel to the cam face of the cam, by which an eccentric abutment of slipper face of the rocker arm onto the cam face is prevented to prevent early abnormal wear, burn, abnormal noise creation, and avoid effection of torsional moment on the rocker arm.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A movable valve device for moving a valve of a combustion engine, comprising a rocker shaft cap to mount a rocker shaft on an upper portion of the engine, said rocker shaft cap being formed with a main body and a spark plug hole generally at a center of the main body, said valve being opened and closed by a camshaft through a rocker arm swingably pivoted to the rocker shaft, wherein a hole engaging member of the rocker arm engages the rocker shaft around an outer circumference of the rocker shaft, an axial centerline of the hole engaging member of the rocker arm being slanted with respect to an axial centerline of said camshaft so as to locate said rocker arm relative to said engine such that the axial centerline of said hole engaging member is slanted with respect to the axial centerline of said rocker shaft.

2. A movable valve device for a combustion engine comprising two intake valves and two exhaust valves on one cylinder of the engine, an ignition plug generally at the center of a combustion chamber associated with said one cylinder of said engine, one camshaft to open and close said intake valves and said exhaust valves, and an intake rocker arm and an exhaust rocker arm to transmit operation of a respective cam of the camshaft to said intake and exhaust valves respectively, and an eccentric spacer sleeve for slanting the rocker arm which has a pivot hole therein for receiving the spacer sleeve, the spacer sleeve having a slanted hole therethrough for receiving a rocker shaft so as to slant an axial centerline of the pivot hole of said rocker arm with respect to an axial centerline of said camshaft.

3. In a combustion engine having a housing defining a piston chamber provided with a combustion chamber at one end thereof, a plug opening substantially aligned with a centerline of the combustion chamber and communicating therewith, a spark plug disposed within the plug opening, first and second intake valves movably supported on said housing and communicating with said combustion chamber on generally opposite sides of said centerline, an elongate cam shaft rotatably mounted on said housing, said cam shaft extending in generally perpendicular relationship relative to the centerline of the piston chamber and disposed sidewardly therefrom, said cam shaft having first and second cams thereon, a rocker shaft assembly mounted on said housing in sidewardly spaced relationship from said cam shaft, said rocker shaft assembly including first and second pivotally movable rocker arms respectively movably displaced by said first and second cams for respectively controlling movement of said first and second intake valves, said first and second rocker arms being disposed on generally opposite sides of said spark plug, comprising the improvement wherein said rocker shaft assembly includes first and second mounting means for respectively mounting said first and second rocker arms for pivotal movement about respective first and second pivot axes which extend at respective first and second angles relative to the axis of the cam shaft, said first and second angles being small and oppositely inclined relative to the cam shaft axis.

4. An engine according to claim 3, wherein said rocker shaft assembly includes a rocker support shaft mounted on said housing in generally parallel but sidewardly spaced relation from said cam shaft, said rocker support shaft including first and second shaft parts mounted on said housing in generally aligned but spaced relationship, and a mounting cap fixed to said housing and being engaged with adjacent ends of said first and second shaft parts for securing the shaft parts to the housing, said cap having said plug opening extending centrally therethrough, said first and second rocker arms being respectively associated with said first and second shaft parts.

5. An engine according to claim 4, wherein each of said first and second mounting means includes a separate intermediate support sleeve mounted in surrounding relationship to the respective shaft part and having an exterior cylindrical surface defined generally about the respective rocker pivot axis, and the respective rocker arm being rotatably supported on the respective exterior cylindrical surface.

6. An engine according to claim 5, wherein the intermediate support sleeve can be rotatably positioned relative to the respective shaft part to determine the plane of the respective rocker pivot axis.

7. An engine according to claim 4, wherein each said mounting means includes a generally cylindrical hub part fixedly associated with the respective shaft part and defining thereon an exterior cylindrical surface defined generally about the respective rocker pivot axis, and the respective rocker arm being rotatably supported on the respective exterior cylindrical surface.

* * * * *